US012245732B2

(12) United States Patent
Libman et al.

(10) Patent No.: US 12,245,732 B2
(45) Date of Patent: Mar. 11, 2025

(54) GRIP HANDLE ASSEMBLY FOR A MOP

(71) Applicant: The Libman Company, Arcola, IL (US)

(72) Inventors: Andrew D. Libman, Champaign, IL (US); Jon Franklin, St. Joseph, IL (US); Fernando de Jesus Santos, Maceira LRA (PT); Marco Bizzotto, Padua (IT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 18/142,833

(22) Filed: May 3, 2023

(65) Prior Publication Data

US 2024/0366056 A1 Nov. 7, 2024

(51) Int. Cl.
*B25G 1/10* (2006.01)
*A47L 13/20* (2006.01)
(Continued)

(52) U.S. Cl.
CPC ..... *A47L 13/42* (2013.01); *A47L 13/20* (2013.01); *A47L 13/58* (2013.01)

(58) Field of Classification Search
CPC ..... A01B 1/026; A47L 13/42; A47L 13/20; A47L 13/58; B25F 5/02; B25F 5/025;
(Continued)

(56) References Cited

U.S. PATENT DOCUMENTS 1,722,130 A 7/1929 Finstad
1,882,918 A 10/1932 Robb
(Continued)

FOREIGN PATENT DOCUMENTS

CN 201646827 U * 11/2010 ..... B62B 5/04
CN 304828473 9/2018
(Continued)

OTHER PUBLICATIONS

Leifheit Clean Twist Disc Ergo Mop and Bucket Set, retrieved from https://www.leifheit.co.uk/leifheit-clean-twist-disc-ergo-mop-and-bucket-set-935-p.asp on Apr. 15, 2022.
(Continued)

*Primary Examiner* — Chuck Y Mah
(74) *Attorney, Agent, or Firm* — Banner & Witcoff, Ltd.

(57) ABSTRACT

A grip handle assembly for a mop includes a grip handle and a lever that is pivotally connected to the grip handle. The grip handle may include a grip handle body that includes a passage the extends through the grip handle body, a lever mount, and a lever stop, where the lever stop includes a central protrusion extending from the grip handle body, a first stop surface, and a second stop surface. The lever may comprise a grip portion, a first forward stop member, a second forward stop member, and a rear stop member. The lever can move to a released position or an engaged position. When the lever is in the released position, the first forward stop member may engage the first stop surface of the lever stop, and the second forward stop member may engage the second strop surface of the lever stop.

20 Claims, 9 Drawing Sheets

(51) Int. Cl.
*A47L 13/42* (2006.01)
*A47L 13/58* (2006.01)

(58) Field of Classification Search
CPC ..... B25F 5/026; B25B 13/52; B25D 17/04; B25D 17/043; B23B 45/001; B25G 1/002; B25G 1/005; B25G 1/102; B25G 1/10; B25G 3/00; B25G 3/02; B25G 3/18; B25G 3/20; B25G 3/24; B25G 3/26; B25G 3/28; B25G 3/30
See application file for complete search history.

(56) References Cited

U.S. PATENT DOCUMENTS 3,040,356 A 6/1962 Vosbikian
D216,277 S 12/1969 James
D227,148 S 6/1973 Oas
4,238,164 A * 12/1980 Mazzolla ..... F16B 7/14 403/109.5
D344,379 S 2/1994 Clark, Jr.
5,288,161 A * 2/1994 Graves ..... B25G 3/18 403/324
D345,236 S 3/1994 Chen
5,414,892 A 5/1995 Clark, Jr.
5,791,006 A * 8/1998 Anctil ..... B25G 1/102 16/427
D417,935 S 12/1999 Primeau
6,023,812 A * 2/2000 Morad ..... A47L 13/52 15/257.7
D482,530 S 11/2003 Evans
6,832,784 B1 * 12/2004 Chen ..... A47L 9/244 285/320
7,144,180 B2 * 12/2006 Stahle ..... F16B 7/10 403/374.1
D557,472 S 12/2007 Renner
7,318,247 B2 1/2008 Libman et al.
D603,115 S 10/2009 McNeil et al.
8,132,287 B2 3/2012 Ting
8,214,963 B2 7/2012 Yu
8,220,101 B2 7/2012 Chen
8,225,454 B2 7/2012 Yang et al.
8,291,538 B2 10/2012 Yang et al.
8,291,544 B2 10/2012 Chen et al.
8,316,502 B2 11/2012 Shao
8,327,502 B2 12/2012 Tsai
8,336,160 B2 12/2012 Chen
8,365,341 B2 2/2013 Lin
8,407,845 B2 4/2013 Yu
8,522,387 B2 9/2013 Chen
8,544,133 B2 10/2013 Fischer et al.
D693,080 S 11/2013 Shao
D694,978 S 12/2013 Libman
D707,003 S 6/2014 Dingert
8,746,267 B2 * 6/2014 Lovley, II ..... F16B 7/1454 135/120.2
8,793,834 B2 8/2014 Lee
8,819,890 B2 9/2014 Lin
8,826,486 B2 9/2014 Lee
8,826,487 B2 9/2014 Lee
8,925,139 B2 1/2015 Shih
8,959,697 B2 2/2015 Yu
D723,758 S 3/2015 Lentine
8,974,194 B2 3/2015 Yin et al.
8,978,194 B1 3/2015 Lentine
D727,580 S 4/2015 Lentine
8,997,305 B1 4/2015 Lentine
D728,882 S 5/2015 Tsai
9,021,648 B1 5/2015 Chu
9,032,579 B1 5/2015 Chen
D789,638 S 6/2017 Rueckheim
9,730,568 B2 8/2017 Lentine
D804,125 S 11/2017 Rueckheim
D819,906 S 6/2018 Beyda et al.
D849,347 S 5/2019 Hekking
D853,670 S 7/2019 Hu
D865,309 S 10/2019 Zheng
D875,339 S 2/2020 Tullney
10,611,013 B2 * 4/2020 Cavaliere ..... B25G 1/04
D903,211 S 11/2020 Gao
D925,850 S 7/2021 Tullney
D927,195 S 8/2021 Wei
11,083,258 B2 * 8/2021 Heim ..... F16B 7/105
11,084,161 B2 * 8/2021 Everingham ..... A47L 9/0673
D935,719 S 11/2021 Huang
D936,303 S 11/2021 Jiang
D936,304 S 11/2021 Jiang
2007/0226929 A1 10/2007 Kao
2008/0276429 A1 * 11/2008 Bukovitz ..... B25G 3/14 403/321
2010/0180460 A1 7/2010 Tang
2011/0209297 A1 * 9/2011 Ramos Valcarce Morcillo ..... A47L 13/59 15/119.1
2011/0225752 A1 9/2011 Yu
2011/0247163 A1 10/2011 Chen
2011/0271472 A1 11/2011 Yang et al.
2011/0271475 A1 11/2011 Yang et al.
2011/0274481 A1 11/2011 Chen
2012/0047675 A1 3/2012 Chu
2014/0000065 A1 * 1/2014 Bukovitz ..... B25G 3/18 403/345
2015/0128373 A1 5/2015 Lin
2016/0206171 A1 7/2016 Metzel et al.
2016/0316984 A1 11/2016 Zhu
2017/0282348 A1 * 10/2017 Mark ..... B25G 1/04
2017/0363157 A1 * 12/2017 Heine ..... F16D 28/00
2018/0085911 A1 * 3/2018 Browning ..... B25G 1/04
2018/0344125 A1 12/2018 Chen et al.
2019/0390852 A1 12/2019 Sigurdson
2021/0186295 A1 6/2021 Ross
2022/0330784 A1 10/2022 Libman

FOREIGN PATENT DOCUMENTS

EP 2255712 A2 12/2010
FR 2818155 A1 * 6/2002 ..... A45B 9/02
KR 20230099172 A * 7/2023
WO 2013052439 A2 4/2013
WO 2013151784 A1 10/2013
WO 2015010577 A1 1/2015

OTHER PUBLICATIONS

YouTube, Video of Libman Spin Mop & Bucket, retrieved from <https://www.youtube.com/watch?v=c2hE-oy5s98> on May 9, 2022.
Amazon.com_ Spin Mop https://www.amazon.com/Masthome-Wringer-Microfiber-Household-Stai nless/dp/B076JC6TTP/ref=sr <http://www.amazon.com/Masthome-Wringer-Microfiber-Household-Stainless/dp/B076JC6TTP/ref%3Dsr>_1_30_sspa (Year: 2018).
Amazon.com_ Libman All-In-One Microfiber Spin Mop https://www.amazon.com/Libman-Bucket-Green-White-Spin/dp/B072Z6VTP2/ref=sr <http://www.amazon.com/Libman-Bucket-Green-White-Spin/dp/B072Z6VTP2/ref%3Dsr_1_2>_1_2 (Year: 2018).

* cited by examiner

GRIP HANDLE ASSEMBLY FOR A MOP

FIELD

Aspects described herein generally relate to a mop with a grip assembly that includes a lever that can release and engage a mechanism on a mop.

BACKGROUND

Mops are used for cleaning all types of surfaces. However, once a mop has been used to clean a surface, the mop head may be dirty and need to be cleaned off prior to applying the mop onto the surface. The mop head may be cleaned by placing the dirty mop into a liquid or water within a bucket and then removing any excess liquid or water from the mop prior to applying it to the surface. A simple means to dewater the mop head is desired. A lever may be arranged on a portion of the mop to assist in engaging and disengaging the dewatering process for the mop.

BRIEF SUMMARY

In light of the foregoing background, the following presents a simplified summary of the present disclosure in order to provide a basic understanding of some aspects of the various implementations of this disclosure. This summary is not an extensive overview of the embodiments described herein. It is not intended to identify key or critical elements, or to delineate the scope of the embodiments described in this disclosure. The following summary merely presents some concepts of the embodiments of this disclosure in a simplified form as a prelude to the more detailed description provided below.

Aspects of the disclosure may relate to a grip handle assembly for a mop that comprises a grip handle is configured to connect to a mop, where the grip handle includes: (a) a grip handle body with a first end and a second end opposite the first end, where the grip handle body has a passage extending from the first end to the second end; (b) a lever mount located nearer the first end than the second end, where the lever mount comprises a first side mount extending from the grip handle body and a second side mount extending from the grip handle body opposite the first side mount; and (c) a lever stop located near the first end of the grip handle body, where the lever stop includes a central protrusion extending from the grip handle body and a first stop surface and a second stop surface. The grip handle assembly may further comprise a lever pivotally connected to the grip handle at the lever mount, where the lever comprises a grip portion, a first forward stop members, a second forward stop member, and a rear stop member. The lever may be movable between a released position and an engaged position, such that when the lever is in the released position, the first forward stop member engages the first stop surface of the lever stop. The grip handle body may include an opening in the grip handle body located between the first side mount and the second side mount. When the lever is in the released position, the rear stop member may engage the grip handle body near a rear end of the opening. The central protrusion, the first stop surface, and the second stop surface may be located adjacent a front end of the opening. When the lever is in the released position, the second forward stop member may engage the second stop surface of the lever stop. The first stop surface may be adjacent the central protrusion on a first side of the central protrusion, and the second stop surface may be adjacent to the central protrusion on a second side of the central protrusion. The lever may comprise a pair of tabs that extend from a lever base at a first end that connect to the lever mount . . . where the pair of tabs are aligned on a lever axis. The first stop surface and the first end of the grip handle body may form an angle of approximately 45 degrees or within a range of 25 and 65 degrees. The lever may withstand a maximum downward force applied to the grip portion within a range of 40 and 50 pounds.

Other aspects of this disclosure may relate to a grip handle assembly for a mop comprising: (a) a grip handle configured to connect to a mop, where the grip handle includes: (1) a grip handle body with a first end and a second end opposite the first end, where the grip handle body has a passage extending from the first end to the second end; a lever mount located nearer the first end than the second end; (2) an opening located near the lever mount; (3) a lever stop located near the first end of the grip handle body, where the lever stop includes a central protrusion extending from the grip handle body and a first stop surface and a second stop surface; and (b) a lever pivotally connected to the grip handle at the lever mount, where the lever comprises a grip portion, a first forward stop members, a second forward stop member, and a rear stop member, where the rear stop member extends into the opening of the grip handle. The lever may be movable between a released position and an engaged position such that when the lever is in the released position, the rear stop member engages an interior surface of the grip handle body. When the lever is in the released position, the first forward stop member may engage the first stop surface of the lever stop, and the second forward stop member may engage the second stop surface of the lever stop. The lever mount may comprise a first side mount extending from the grip handle body and a second side mount extending from the grip handle body opposite the first side mount. The first stop surface may be adjacent the central protrusion on a first side of the central protrusion, and the second stop surface may be adjacent to the central protrusion on a second side of the central protrusion. The central protrusion and stop surfaces may be located adjacent a front end of the opening. The lever can withstand a maximum downward force applied to the grip portion within a range of 40 and 50 pounds.

Still other aspects of this disclosure may relate to a grip handle assembly for a spin mop comprising: (a) a grip handle configured to connect to handle assembly of a spin mop, where the grip handle includes: (1) a grip handle body with a first end and a second end opposite the first end, where the grip handle body may have a passage extending from the first end to the second end, and a shoulder within the passage, where the shoulder is configured to engage a brake bushing; (2) a lever mount located nearer the first end than the second end, where the lever mount comprises a first side mount extending from the grip handle body and a second side mount extending from the grip handle body opposite the first side mount; (3) an opening in the grip handle body located between the first side mount and the second side mount; (4) a lever stop located near the first end of the grip handle body, where the lever stop includes a central protrusion extending from the grip handle body and a first stop surface and a second stop surface, and where the central protrusion and stop surfaces are located at a front end of the opening; (b) a lever pivotally connected to the grip handle at the lever mount, where the lever comprises a grip portion, a first forward stop members, a second forward stop member, and a rear stop member, the rear stop member extending into the opening of the grip handle. The lever may be movable between a released position or an engaged position. When the lever is in the released position, the first forward stop member may engage the first stop surface of the lever stop, and the second forward stop member may engage the second stop surface of the lever stop. When the lever is in the released position, the rear stop member may engage the grip handle body near the rear end of the opening. The first stop surface and the first end of the grip handles may form an angle within a range of 25 and 65 degrees.

The lever can withstand a maximum downward force applied to the grip portion within a range of 40 and 50 pounds.

BRIEF DESCRIPTION OF THE DRAWINGS

The present disclosure is illustrated by way of example and not limited in the accompanying figures in which like reference numerals indicate similar elements and in which.

DETAILED DESCRIPTION

In the following description of various illustrative arrangements, reference is made to the accompanying drawings, which form a part hereof, and in which is shown, by way of illustration, various arrangements in which aspects of the disclosure may be practiced. It is to be understood that other arrangements may be utilized and structural and functional modifications may be made, without departing from the scope of the present disclosure. Also, while the terms "front." "rear." "top." and "side." and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims. It is noted that the accompanying drawings may not be drawn to scale. It is noted that various connections between elements are discussed in the following description. It is noted that these connections are general and, unless specified otherwise, may be direct or indirect, and that the specification is not intended to be limiting in this respect.

The following terms are used in this specification, and unless otherwise noted or clear from the context, these terms have the meanings provided below.

"Generally planar" means that a surface is level and aligned with another surface, such that the two surfaces form a substantially flat single surface, within a tolerance of +/−0.05 inches.

In general, this disclosure relates to a grip handle assembly for a mop. In some examples, the grip handle assembly may be connected to a mop system comprising a spin mop and a bucket assembly where the spin mop engages the bucket assembly to assist in dewatering the mop. In short, when the mop head engages a wringer basket of a bucket assembly, the spinning of the mop head may cause the wringer basket to spin with it, which causes excess water to be forced from the yarns of the mop head. Therefore, dewatering the mop head and preparing it for use. The mop head may be configured to pivot along two different axes to allow a movement of the handle assembly to drive the rotation of the wringer basket even when the handle assembly is arranged at different angles relative to the mop head. In other examples, the grip handle assembly may be connected to a different type of mop such as a sponge mop or other mop know to one skilled in the art to dewater the sponge.

Figure 1:
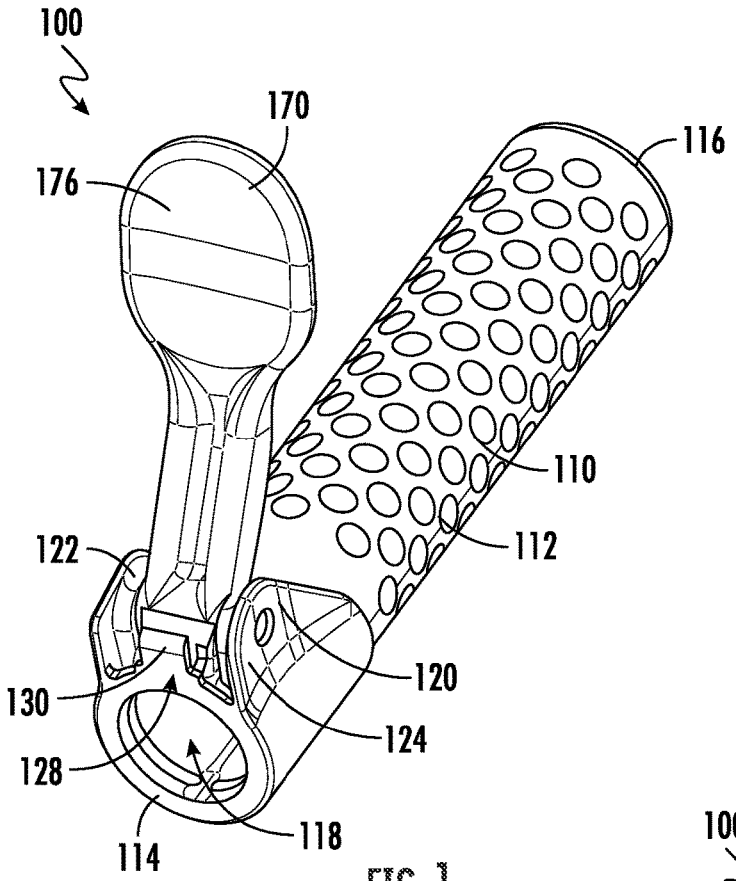
FIG. 1 illustrates a top front perspective view of a grip handle assembly for a mop with the lever in a released position according to aspects described herein.
Figure 2:
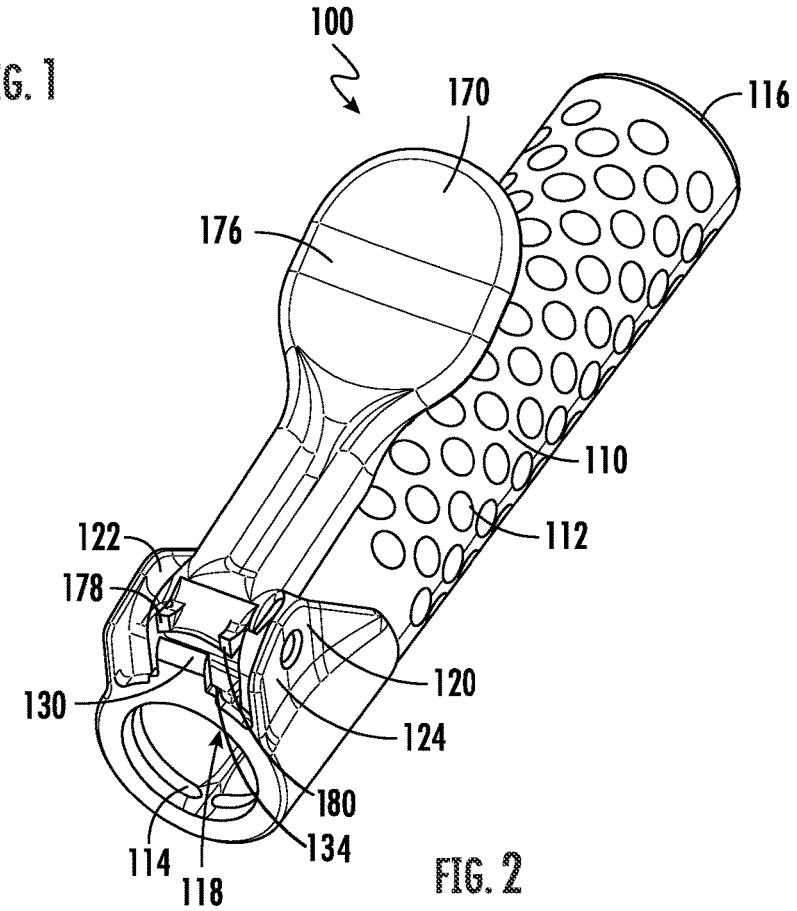
FIG. 2 illustrates a top front perspective view of the grip handle assembly of FIG. 1 with the lever in an engaged position according to aspects described herein.
Figure 3:
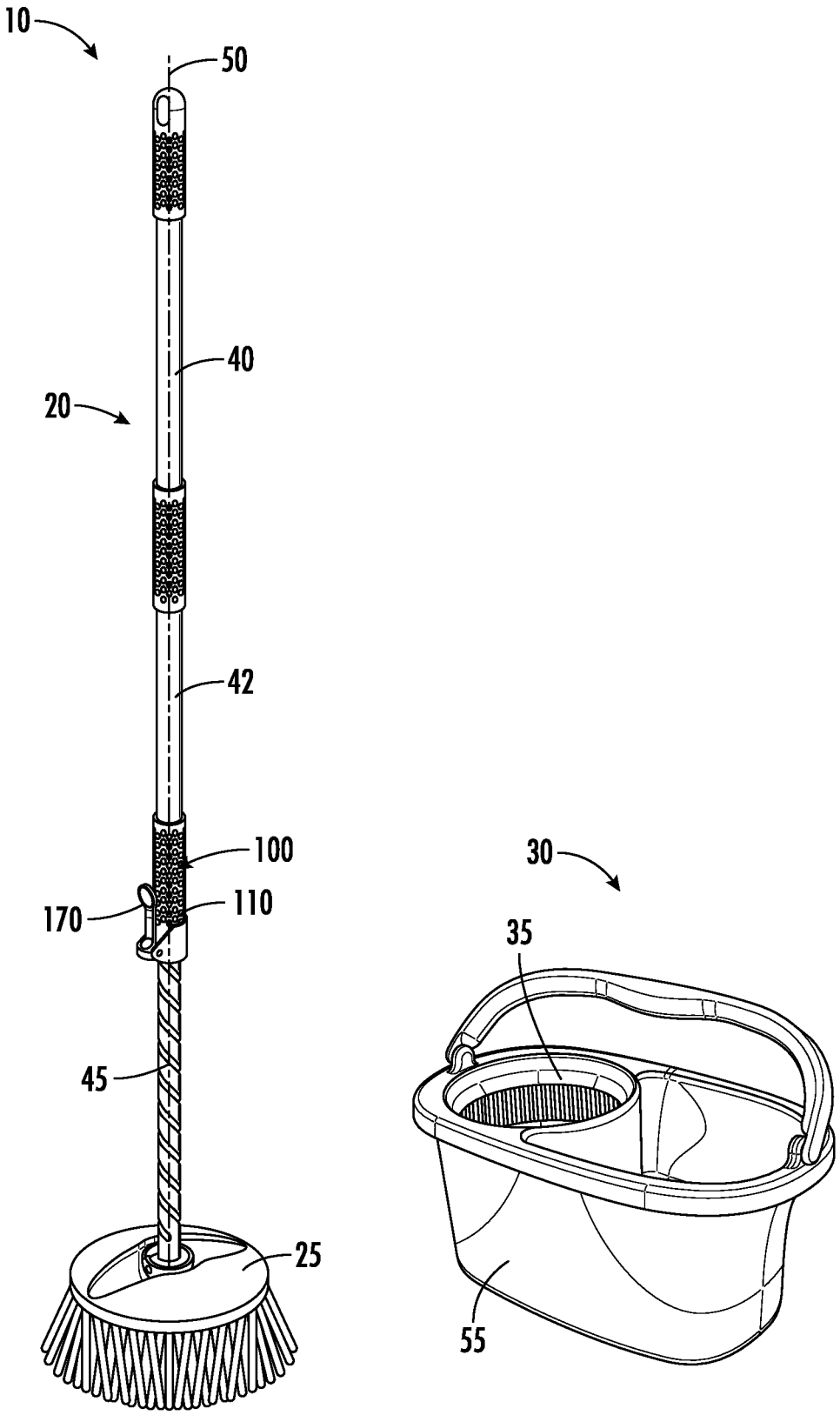
FIG. 3 illustrates a front perspective view of a mop system with the grip handle assembly of FIG. 1 according to aspects described herein.
Figure 4:
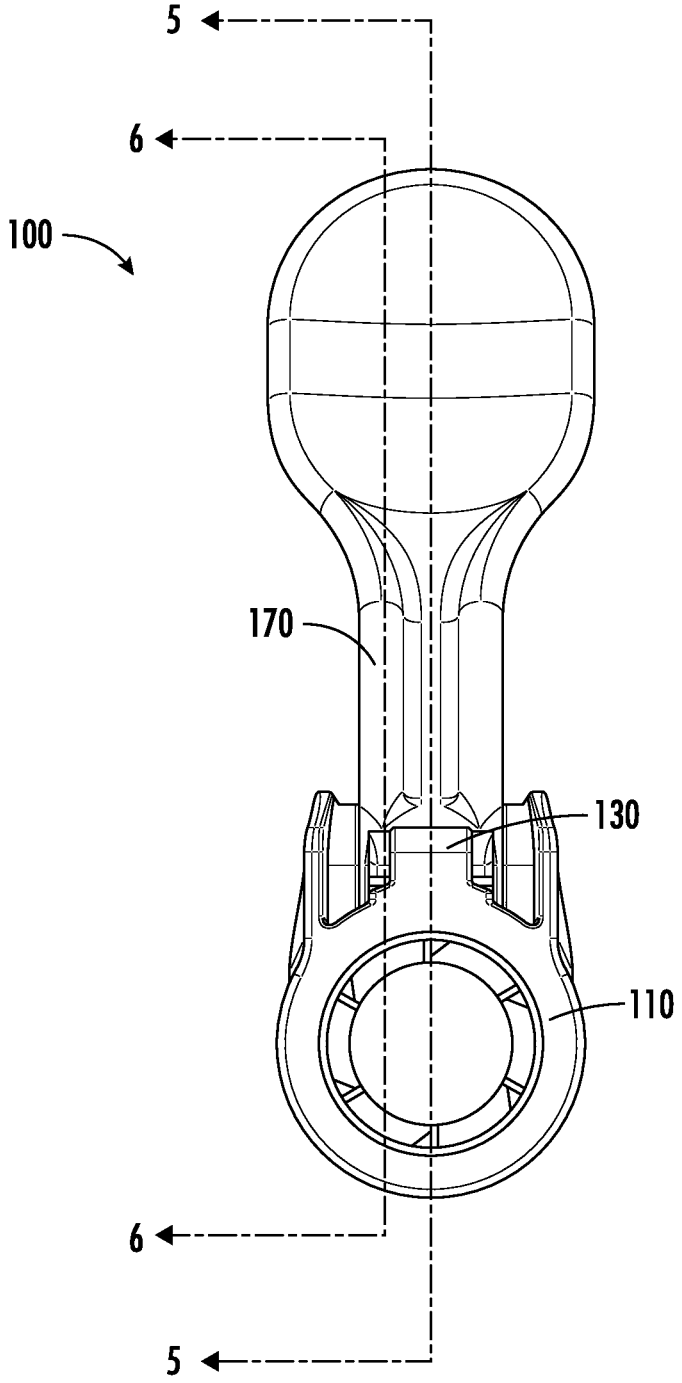
FIG. 4 illustrates a front view of the grip handle assembly of FIG. 1 with the lever in a released position according to aspects described herein.

FIGS. 1 and 2 illustrate the grip handle assembly 100. In FIG. 1, the lever 170 is shown in an unlocked or released position, and in FIG. 2 the lever 170 is shown in a locked or engaged position. The exemplary grip handle assembly 100 may be used with a spin mop system 10 as shown in FIG. 3 that includes a spin mop 20 and a bucket assembly 30, where the spin mop 20 engages a wringer basket 35 of the bucket assembly 30 to dewater a mop head 25 of the spin mop 20. The spin mop system 10 may be similar to the spin mop system described in U.S. patent Ser. No. 17/235,679 filed on Apr. 20, 2021, which is incorporated by reference in its entirety. The spin mop 20 may include a handle assembly 40 that defines a longitudinal axis 50 of the spin mop 20. The spin mop 20 may also include a drive mechanism that comprises a spiral member 45 that is slidably engaged with the handle assembly 40 and also pivotally engaged with the mop head 25. The bucket assembly 30 may include a bucket 55 to hold a cleaning solution, and a wringer basket 35 that is rotatably engaged with an axle member of the bucket 55.

After the mop head 25 has been submerged in the cleaning solution contained in the bucket 55, the spin mop 20 may be received in and engage the wringer basket 35 to assist in dewatering the mop head 25 to ensure the mop head 25 has the desired moisture content for the intended cleaning task. The mop head 25 may be placed into the wringer basket 35. Once the mop head 25 is received in the wringer basket 35, the lever 170 may be moved (i.e. rotated or lifted) to a released position to release a brake bushing 80 that allows the handle tube 42 of the handle assembly 40 to slidably move along the spiral member 45. As the spiral member 45 rotates, the spiral member 45 causes the mop head 25 to rotate (i.e., spin). The spinning of the mop head 25 then causes the wringer basket 35 to spin in the same direction as the rotation of the mop head 25 creating a centrifugal force to cause any excess cleaning solution, or liquid, to be forced from the yarns of the mop head 25.

The handle assembly 40 may include a handle tube 42 and a grip handle assembly 100 near the lower end of the handle tube 42. The grip handle assembly 100 may include a lever 170 that is pivotally attached to the grip handle 110. The lever 170 may engage a brake bushing 80 within the grip handle 110 that engages the spiral member 45, where the lever 170 has a locked positioned that prevents the handle assembly 40 from moving relative to the spiral member 45 and an unlocked position that releases the brake bushing 80 which allows the brake bushing 80 along with the handle assembly 40 to slide downward on the spiral member 45. The lever 170 may engage the brake bushing 80 by compressing flexible fingers on the brake bushing 80 to prevent the handle tube 42 from moving relative to the spiral member 45 when in the locked position. As these components move along the spiraled surface of the spiral member 45, the spiral member 45 rotates causing the mop head 25 to spin.

The grip handle assembly 100 for the mop 20 may comprise a grip handle 110 that connects to a handle tube 42 of the mop 20 and a lever 170 that is pivotally engaged with the grip handle 110. The grip handle 110 may include a grip handle body 112 with a first end 114 and a second end 116 opposite the first end 114, wherein the grip handle body 112 has a passage 118 extending from the first end 114 to the second end 116. The grip handle 110 may further comprise a lever mount 120 nearer the first end 114 than the second end 116, where the lever mount 120 comprises a first side mount 122 extending from the grip handle body 112 and a second side mount 124 extending from the grip handle body 112 opposite the first side mount 122. An opening 126 may be located in the grip handle body 112 between the first side mount 122 and the second side mount 124. A lever stop 128 may be positioned near the first end 114 (i.e., closer to the first end 114 than the second end 116) of the grip handle body 112. In some examples, the lever stop 128 may be positioned at the first end 114 of the grip handle body 112. The lever stop 128 may include a central protrusion 130 extending from the grip handle body 112 and a first stop surface 132 and a second stop surface 134. The first stop surface 132 may be adjacent to the central protrusion 130 and located on a first side of the central protrusion 130, and the second stop surface 134 may be adjacent to the central protrusion 130 and located on a second side of the central protrusion 130 opposite the first side of the central protrusion 130. In some examples, the central protrusion 130 and first and second stop surfaces 132, 134 may be located near and/or at a front end 136 of the opening 126.

Figure 10:
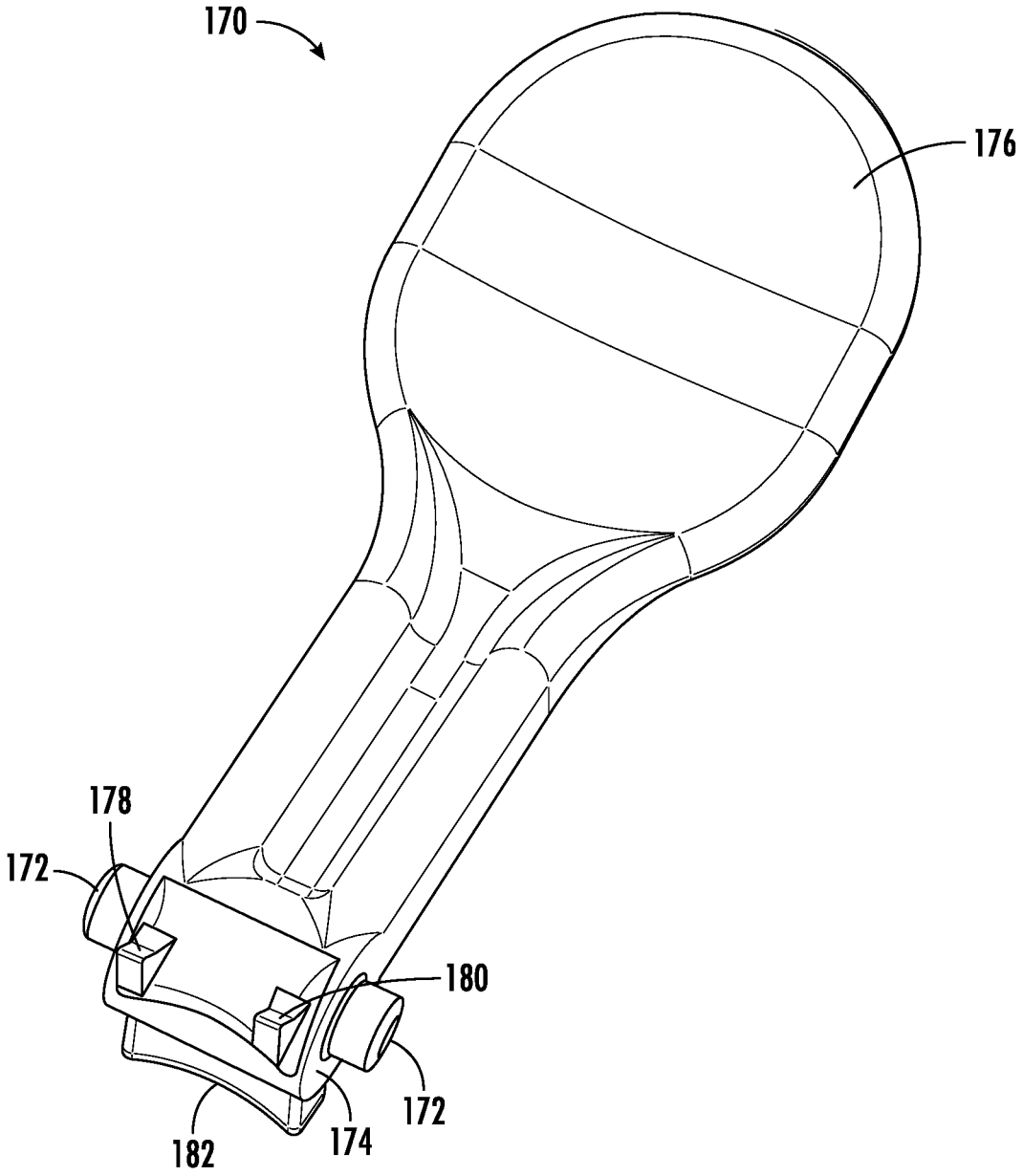
FIG. 10 illustrates a perspective view of an exemplary grip handle of the grip handle assembly of FIG. 1 according to aspects described herein.
Figure 11:
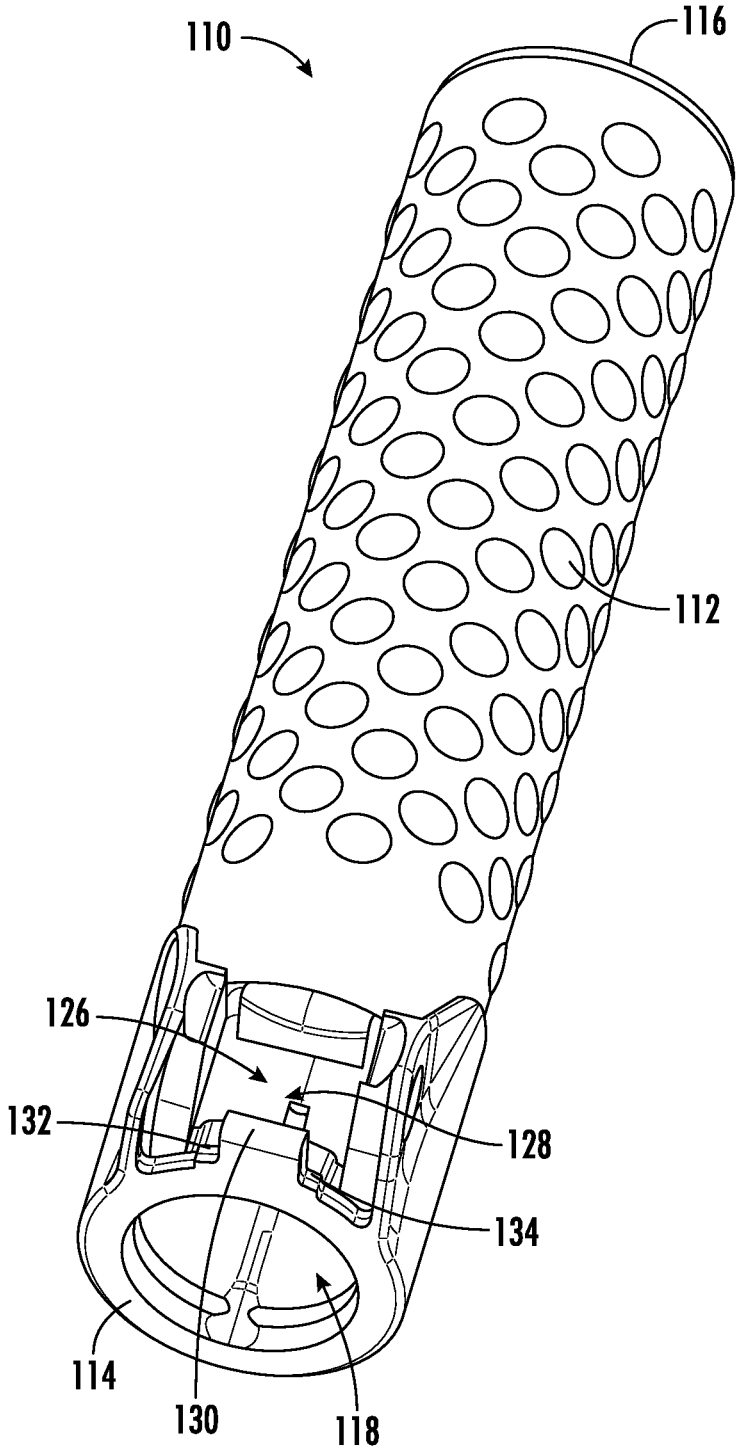
FIG. 11 illustrates a perspective view of an exemplary lever of the grip handle assembly of FIG. 1 according to aspects described herein.

The lever 170 may be pivotally connected to the grip handle 110 at the lever mount 120. As shown in FIG. 10, the lever 170 may comprise a pair of tabs 172 extending from a lever base 174 that connect to the lever mount 120. Each tab 172 may be aligned on a lever axis. The lever 170 may further comprise a grip portion 176, a first forward stop member 178, a second forward stop member 180, and a rear stop member 182. The forward stop members 178, 180 and the rear stop member 182. The rear stop member 182 may extend into the opening 126 of the grip handle body 112.

Figure 5:
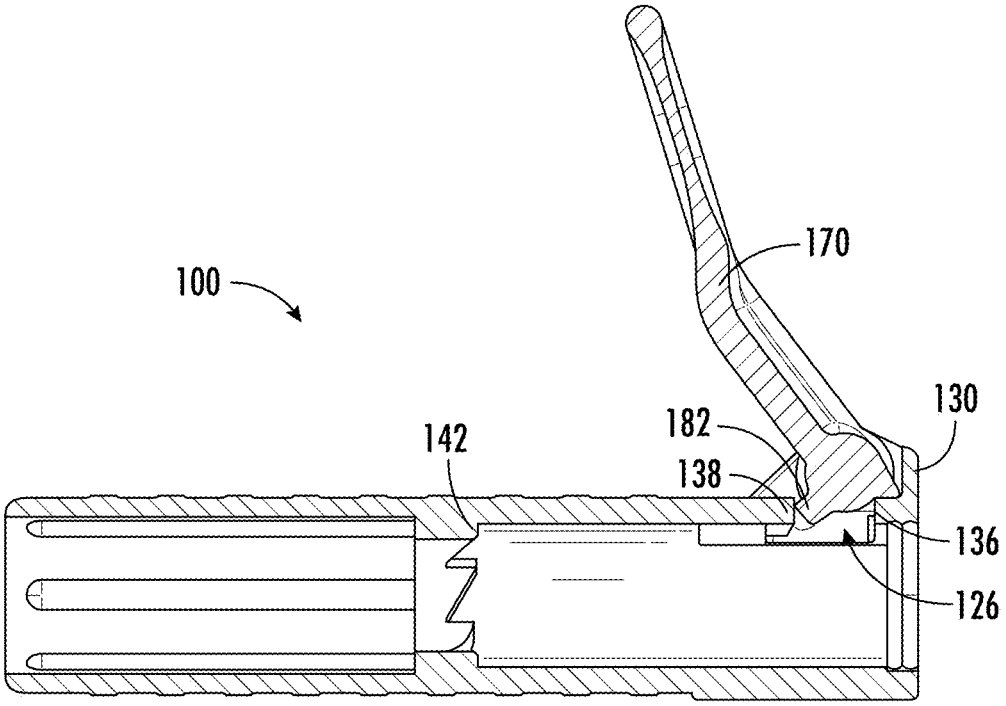
FIG. 5 illustrates a cross-sectional side view of the grip handle assembly along line 5-5 as shown in FIG. 4 according to aspects described herein.
Figure 6:
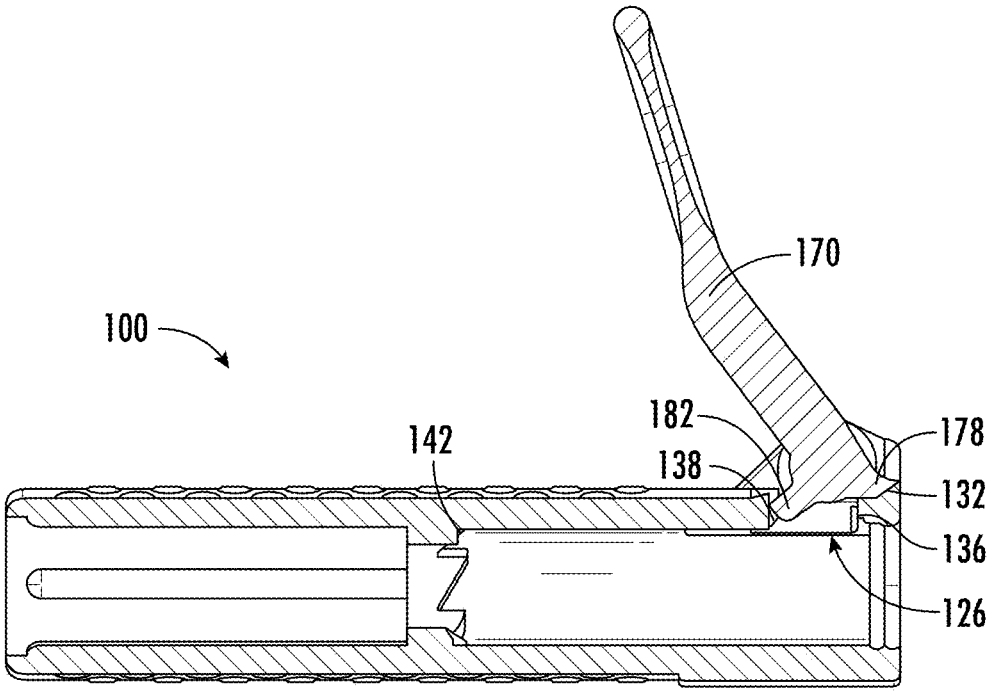
FIG. 6 illustrates a cross-sectional side view of the grip handle assembly along line 6-6 as shown in FIG. 4 according to aspects described herein.

As discussed above, the lever 170 may be moved to a released or unlocked position as shown in FIGS. 1 and 4-6, or an engaged or locked position as shown in FIGS. 2 and 7-9. When the lever 170 is in the released position, at least one of the first and second forward stop members 178, 180 of the lever 170 engages or contacts the first and second stop surfaces 132, 134 of the lever stop 128 as shown in FIG. 6. The first and second stop surfaces 132, 134 may be generally planar such that the majority of the surface area of each of the first and second stop surfaces engages 132, 134 each engaging surface of the first and second forward stop members 178, 180 of the lever 170. The engaging surface of the forward stop members 178, 180 may also be generally planar. In addition, in some examples, when the lever 170 is in the released position, the rear stop member 182 may engage or contact the grip handle body 112 near a rear end 138 of the opening 126 as shown in FIGS. 5 and 6. The grip handle 110 may also comprise an internal shelf 142 that is configured to engage and support a brake bushing 80. When the lever 170 is in the released position, the brake bushing 80 has the compression force applied by the rear stop member 182 removed to allow the handle assembly 40 and spiral member 45 to move relative to each other.

Figure 7:
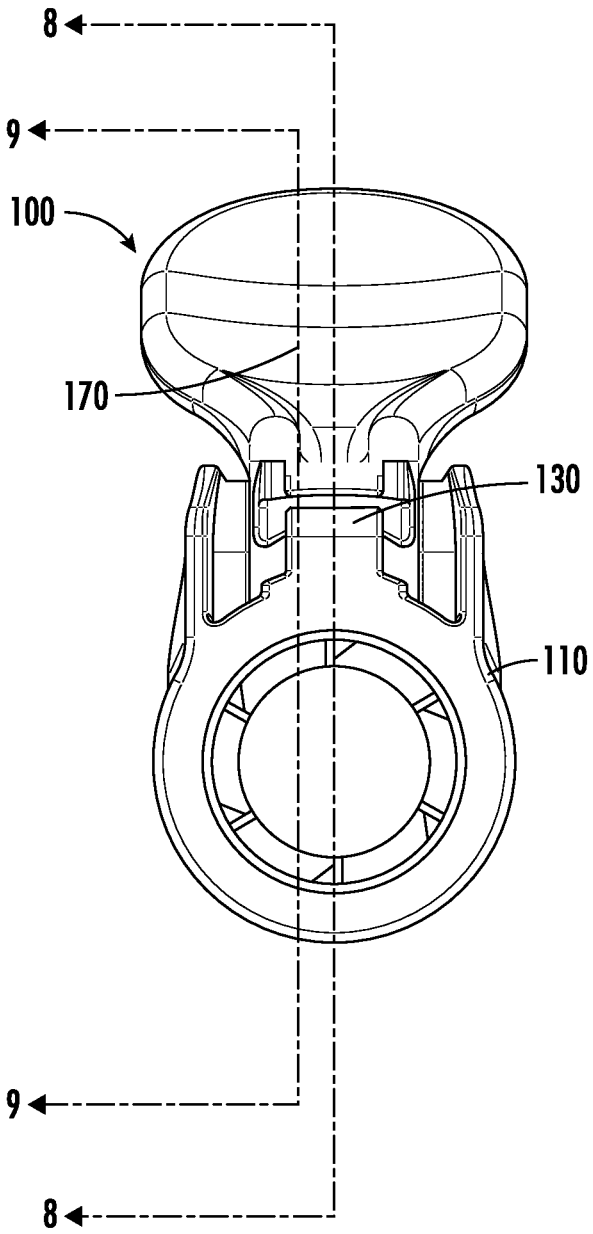
FIG. 7 illustrates a front view of the grip handle assembly of FIG. 2 with the lever in an engaged position according to aspects described herein.
Figure 8:
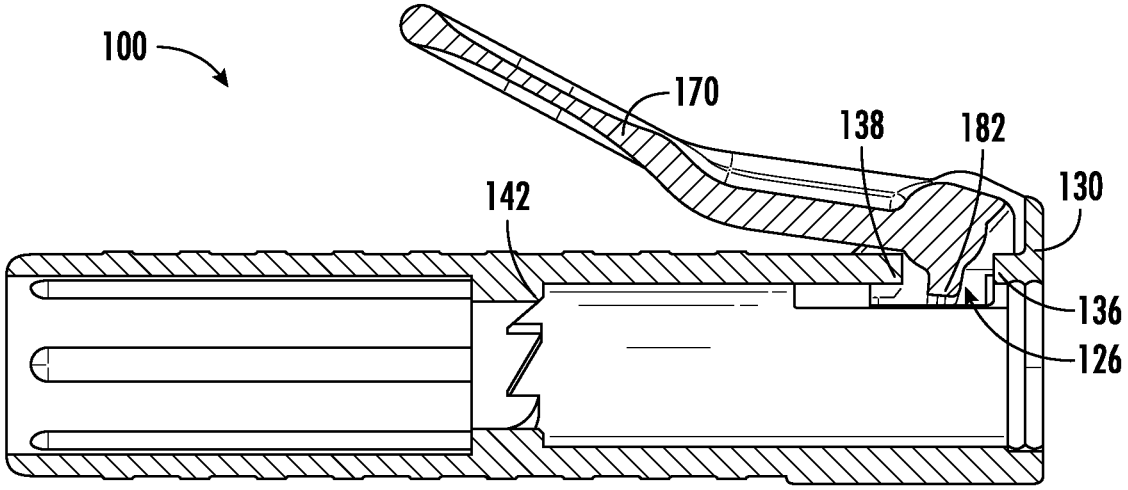
FIG. 8 illustrates a cross-sectional side view of the grip handle assembly along line 8-8 as shown in FIG. 7 according to aspects described herein.
Figure 9:
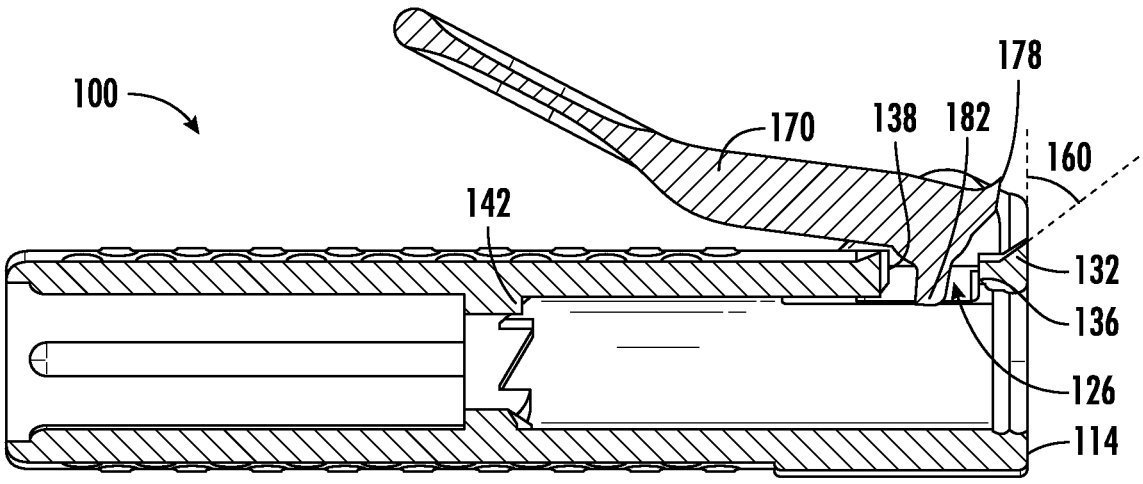
FIG. 9 illustrates a cross-sectional side view of the grip handle assembly along line 9-9 as shown in FIG. 7 according to aspects described herein.
Figure 13:
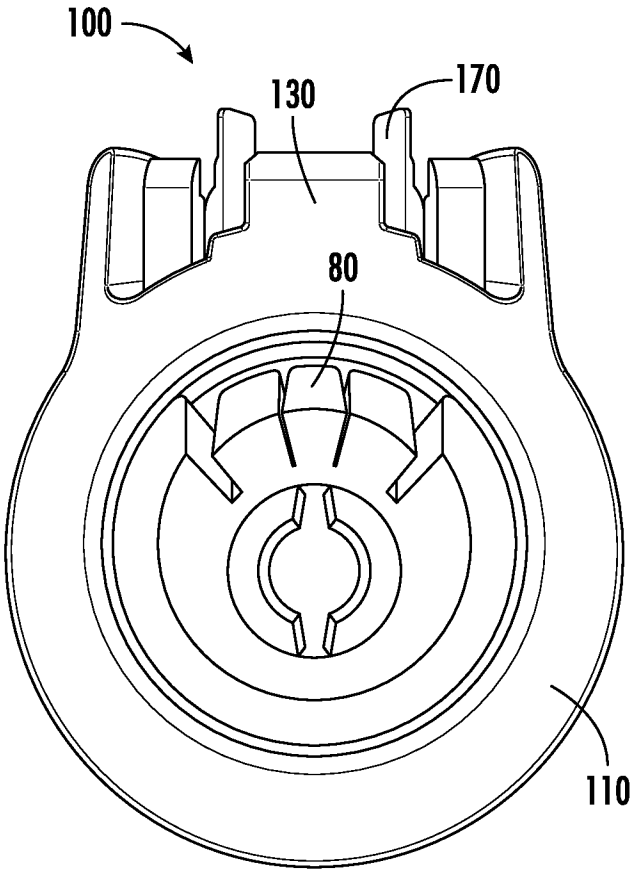
FIG. 13 illustrates a front perspective view of an exemplary grip handle assembly of FIG. 1 in an engaged position.

FIGS. 7-9 illustrate the grip handle assembly 100 in the locked position. When the lever 170 is in the locked position, the rear stop member 182 extends into the opening 126 and engages the flexible fingers of the brake bushing 80 which creates a clamping force onto the handle tube 42 to prevent any movement between the handle assembly 40 and the spiral member 45 as shown in FIG. 13. FIGS. 8 and 9 illustrate the first and second forward stop members 178, 180 being free of contact with the first and second stop surfaces 132, 134 of the lever stop 128. As best shown in the cross-sectional view of FIG. 9, an angle 160 between the first stop surface 132 and the surface of the first end 114 of the grip handle body 112 may be approximately 45 degrees, or within a range of 25 and 65 degrees. By utilizing the forward stop members 178, 180 on the lever 170 to contact the stop surfaces 132, 134 respectively of the grip handle body 112 and the rear stop member 182 to contact an interior surface of the grip handle body 112 near or at a rear end 138 of the opening 126, the lever 170 may withstand a maximum downward force applied by a user of approximately 50 pounds, or within a range of 45 and 50 pounds, or within a range of 40 and 50 pounds. The downward force may be tested using a force gauge that is capable of recording a pulling or pushing force. To test the maximum force capable by the lever 170, the lever 170 is moved to an unlocked position to an angle of approximately 45° to the grip handle body 112. The force gauge's peg attachment is placed against the grip portion 176 of the lever 170 that is facing the grip handle body 112. A force is then applied to lever 170 towards the mop head 25 while holding onto the gauge and the handle tube 42 until wither either the lever 170 or the grip handle 110 break in a way that allows the lever 170 to approach an angle nearly 180° from the locked position of the lever 170. The maximum force used to break the lever 170 or the grip handle 110 is recorded.

Figure 12:
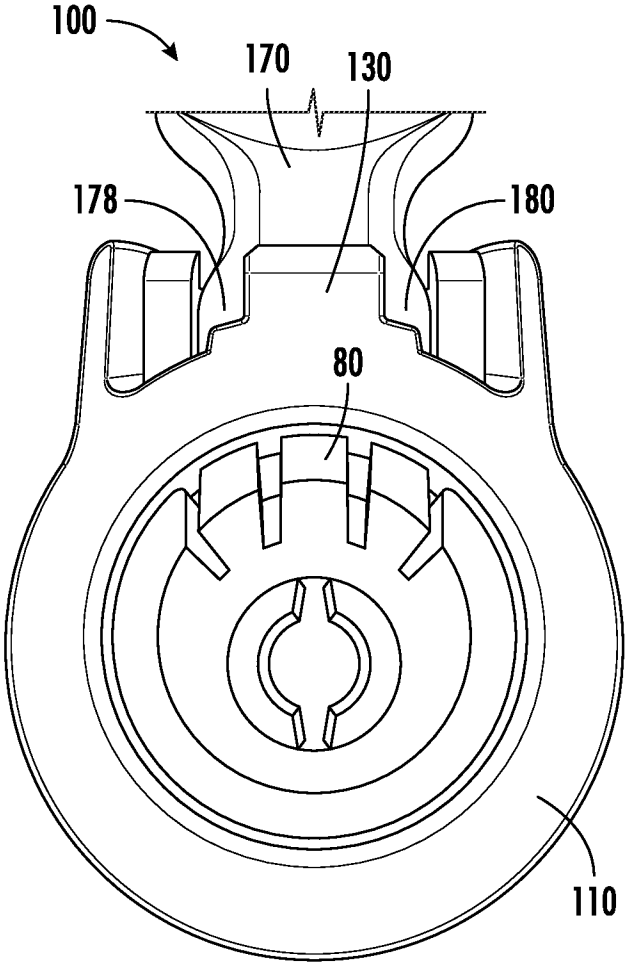
FIG. 12 illustrates a front perspective view of an exemplary grip handle assembly of FIG. 1 in a released position.

FIGS. 12 and 13 illustrate front views of the grip handle assembly 100 with the brake bushing 80 received within the grip handle 110. FIG. 13 illustrates the lever 170 in the locked position with fingers of the brake bushing 80 in a compressed state. FIG. 12 illustrates the lever 170 in an unlocked position with the fingers of the brake bushing 80 in an uncompressed state.

The various components of the grip handle assembly 100 such as the grip handle 110 and the lever 170 may be formed from a polymeric material, such as a nylon or polycarbonate, using a molding, forming, cutting, or other process known to one skilled in the art. Optionally or alternatively, any or all of these components may be formed from a metallic material.

Aspects of the disclosure have been described in terms of illustrative examples thereof. Numerous other examples, modifications, and variations within the scope and spirit of the appended claims will occur to persons of ordinary skill in the art from a review of this disclosure. For example, one or more of the steps depicted in the illustrative figures may be performed in other than the recited order, and one or more depicted steps may be optional in accordance with aspects of the disclosure.

What is claimed is:

1. A grip handle assembly connected to a handle tube of a mop comprising:

a grip handle comprising:

a grip handle body with a first end and a second end opposite the first end, wherein the grip handle body has a passage extending from the first end to the second end;

a lever mount located nearer the first end than the second end, wherein the lever mount comprises a first side mount extending from the grip handle body and a second side mount extending from the grip handle body opposite the first side mount;

a lever stop located near the first end of the grip handle body, wherein the lever stop includes a central protrusion and a first stop surface extending from the grip handle body;

a lever pivotally connected to the grip handle at the lever mount;

the lever comprises a grip portion, a first forward stop members and a rear stop member;

wherein the lever is movable between a released position that allows slidable movement between the handle tube and a secondary member of the mop, and an engaged position that prevents slidable movement between the handle tube and the secondary member of the mop; and wherein when the lever is in the released position, the first forward stop member engages the first stop surface of the lever stop.

2. The grip handle assembly of claim 1, wherein the grip handle body includes an opening in the grip handle body located between the first side mount and the second side mount.

3. The grip handle assembly of claim 2, wherein when the lever is in the released position, the rear stop member engages the grip handle body near a rear end of the opening.

4. The grip handle assembly of claim 2, wherein the central protrusion and the first stop surface are located adjacent a front end of the opening.

5. The grip handle assembly of claim 1, wherein the lever stop further comprises a second stop surface extending from the grip handle body and the lever comprises a second forward stop member, and wherein when the lever is in the released position, the second forward stop member engages the second stop surface of the lever stop.

6. The grip handle assembly of claim 5, wherein the first stop surface is adjacent the central protrusion on a first side of the central protrusion, and the second stop surface is adjacent to the central protrusion on a second side of the central protrusion.

7. The grip handle assembly of claim 1, the lever comprises a pair of tabs extending from a lever base at a first end that connect to the lever mount.

8. The grip handle assembly of claim 1, wherein the first stop surface and the first end of the grip handle body has an angle of approximately 45 degrees.

9. The grip handle assembly of claim 1, wherein the first stop surface and the first end of the grip handles has an angle within a range of 25 degrees and 65 degrees.

10. The grip handle assembly of claim 1, wherein the lever can withstand a maximum downward force applied to the grip portion within a range of 40 pounds and 50 pounds.

11. A grip handle assembly connected to a handle tube of a mop comprising:

a grip handle comprising:

a grip handle body with a first end and a second end opposite the first end, wherein the grip handle body has a passage extending from the first end to the second end;

a lever mount located nearer the first end than the second end;

an opening located near the lever mount;

a lever stop located near the first end of the grip handle body, wherein the lever stop includes a central protrusion and a first stop surface extending from the grip handle body;

a lever pivotally connected to the grip handle at the lever mount;

the lever comprises a grip portion, a first forward stop members and a rear stop member, wherein the rear stop member extends into the opening of the grip handle;

wherein the lever is movable between a released position that allows slidable movement between the handle tube and a secondary member of the mop, and an engaged position that prevents slidable movement between the handle tube and the secondary member of the mop; and wherein when the lever is in the released position, the rear stop member engages an interior surface of the grip handle body.

12. The grip handle assembly of claim 11, wherein the lever stop further comprises a second stop surface and the lever comprises a second forward stop member; and wherein when the lever is in the released position, the first forward stop member engages the first stop surface of the lever stop, and the second forward stop member engages the second stop surface of the lever stop.

13. The grip handle assembly of claim 11, wherein the lever mount comprises a first side mount extending from the grip handle body and a second side mount extending from the grip handle body opposite the first side mount.

14. The grip handle assembly of claim 12, wherein the first stop surface is adjacent the central protrusion on a first side of the central protrusion, and the second stop surface is adjacent to the central protrusion on a second side of the central protrusion.

15. The grip handle assembly of claim 11, wherein the central protrusion and first stop surface is located adjacent a front end of the opening.

16. The grip handle assembly of claim 11, wherein the lever can withstand a maximum downward force applied to the grip portion within a range of 40 pounds and 50 pounds.

17. A grip handle assembly connected to a handle tube of a spin mop comprising:

a grip handle comprising:

a grip handle body with a first end and a second end opposite the first end, wherein the grip handle body has a passage extending from the first end to the second end;

a lever mount located nearer the first end than the second end, wherein the lever mount comprises a first side mount extending from the grip handle body and a second side mount extending from the grip handle body opposite the first side mount;

an opening in the grip handle body located between the first side mount and the second side mount;

a lever stop located near the first end of the grip handle body, wherein the lever stop includes a central protrusion extending from the grip handle body and a first stop surface and a second stop surface, wherein the central protrusion, the first stop surface, and the second stop surface are located at a front end of the opening; and a lever pivotally connected to the grip handle at the lever mount, the lever comprising a grip portion, a first forward stop member, a second forward stop member, and a rear stop member, the rear stop member extending into the opening of the grip handle;

wherein the lever is movable between a released position that allows slidable movement between the handle tube and a secondary member of the spin mop, and an engaged position that prevents slidable movement between the handle tube and a secondary member of the spin mop; and wherein when the lever is in the released position, the first forward stop member engages the first stop surface of the lever stop, and the second forward stop member engages the second stop surface of the lever stop.

18. The grip handle assembly of claim 17, wherein when the lever is in the released position, the rear stop member engages the grip handle body near a rear end of the opening.

19. The grip handle assembly of claim 17, wherein the first stop surface and the first end of the grip handles has an angle within a range of 25 degrees and 65 degrees.

20. The grip handle assembly of claim 17, wherein the lever can withstand a maximum downward force applied to the grip portion within a range of 40 pounds and 50 pounds.

* * * * *